United States Patent [19]

Bechu

[11] Patent Number: 4,819,565

[45] Date of Patent: Apr. 11, 1989

[54] TUBULAR JOINT FORMED BY TWO ROLLING MEMBRANES UNDER LOW PRESSURIZATION FOR INTERCOMMUNICATION RING

[75] Inventor: Jean-Pierre Bechu, Courbevoie, France

[73] Assignee: Kleber Industrie, Versailles, France

[21] Appl. No.: 54,860

[22] Filed: May 27, 1987

[30] Foreign Application Priority Data

May 27, 1986 [FR] France ..... 86 07696

[51] Int. Cl.[4] ..... B61D 17/22

[52] U.S. Cl. ..... 105/11; 105/15; 277/34; 280/403

[58] Field of Search ..... 105/8.1, 10, 11, 12, 105/13, 14, 15, 20, 21; 280/403, 424; 296/166; 49/477; 403/50, 220; 277/34.3, 34, 34.6; 285/97

[56] References Cited

U.S. PATENT DOCUMENTS 474,796 5/1892 Kittredge et al. ..... 105/15
487,776 12/1892 Rosa ..... 105/15
3,399,632 9/1968 Dean ..... 105/15
3,996,859 12/1976 Heisler et al. ..... 105/15
4,539,912 9/1985 Hassel et al. ..... 105/15 X

FOREIGN PATENT DOCUMENTS 206910 12/1986 European Pat. Off. ..... 105/8.1

*Primary Examiner*—Leonard E. Smith
*Attorney, Agent, or Firm*—Antonelli, Terry & Wands

[57] ABSTRACT

A tubular joint for connecting an intercommunication tunnel forming a passage compartment placed between two successive railroad on road vehicles or two successive members of access gangways to ships or to planes, said tubular joint being fitted on one hand to lateral, upper and lower walls of said vehicles or of said access gangways and on the other hand on said intercommunication tunnel, and being inflated with a gas under a relative pressure of 0.1 to 0.5 bar; said tubular joint having a symmetry plane and being composed of two rolling membranes (1*a*), (1*b*), that are U-Shaped, assembled by tightening of their ends (11*a*) and (11*b*) in said symmetry plane of said tubular joint (1) to provide a connection which can withstand all pulls exerted on the intercommunication tunnel.

12 Claims, 7 Drawing Sheets

TUBULAR JOINT FORMED BY TWO ROLLING MEMBRANES UNDER LOW PRESSURIZATION FOR INTERCOMMUNICATION RING

BACKGROUND OF THE INVENTION

1. Field of the Invention

The invention relates to railroad or road vehicles for passengers, wherein intercommunication through weather- and noise-proof gangways is arranged between several successive vehicles. By extension, it also applies to the access gangways for an airplane or a ship which displays analogous kinematics.

A usual design in railroad construction, especially for railways with several indivisible vehicles or urban subways, is to provide passengers free circulation on the length of the train with the least possible amount of physical or visual obstacles. An improvement of services offered on the train, a possible distribution of the crowds and safety against aggression and vandalism are sought as much as possible by open gangway means on the entire width of the vehicles without making use of separating doors even if they are automatic.

2. Description of the prior art

Known solutions such as the various kinds of bellows that are used in the construction of traditional railway vehicles or articulated buses do not meet the requirements of total weather proofing and especially soundproofing of the same level as that requested in the walls of the vehicles with collapsible elements.

The tramway systems use a rigid gangway, which can reach the same soundproofing level as the walls of the vehicles, each half of said gangway swivel around a vertical axis that is fitted to each vehicle body and will be fastened with appropriate sealing joints.

Patent FR No. 2 357 409 of Alsthom Atlantique describes a means to connect those two intercommunication halves with a crosswise horizontal axis close to the floor and supported by a median bogie between two vehicles, thus connected when a rolling occurs, but this system is not suitable for the linkage of more than two vehicles. The document EP No. 0134 202 from Fiat Ferroviara Savigliano describes a means for linking two intercommunication tunnel halves with a single common point ensured by a spheric swivel joint, conventional seals between the rigid walls allowing for rolling motion between the vehicles thus connected.

The document FR No. 2 569 149 from SIG describes an elastic linkage that allows for small motions between the two halves of an intercommunication tunnel, beyond which occurs a shift through friction that enables the use of conventional bellows, in conformance with the standards of the International Railroad Union (Union internationale des chemins de fer). Sealing membranes, that are U-shaped, fastened parallel to the walls of the vehicles, are described therein for the purpose of connecting a vehicle to a frame, which can swivel or flutter in relation with the vehicles.

The patent application FR No. 2 571 010 of the RATP describes an intercommunication device between railroad vehicles which is positioned, at each end of the vehicle with a flexible pneumatic joint.

Such a continuous pneumatic joint, with the necessary size, which, according to the inventor, has the shape, in a free state of a kind of large tire inner tube is impossible to manufacture with the conventional means of the rubber processing industry.

The fastening means that is described in FIG. 10 of said patent necessitates pressing the pneumatic O-ring parallel to plane and cylindrical sides. Prior to the end of manufacturing the endless joint it would be necessary to insert anchoring metal plates, the perimeter of which would have to vary during tightening for proofing.

In spite of the theoretical interest of the described device, the known means which are conventionally used in the rubber processing industry do not allow for economical manufacturing of such a large flexible pneumatic joint.

Furthermore, soundproofing measurements, described in the patent application FR No. 85 16816 of the applicant, highlights the need for a rubber thickness of about 12 millimeters in order for such a membrane to achieve acoustic efficiency. Such requirements cannot be performed by the previously described membranes because such thickness leads to insufficient flexibility in operation.

Above cited tests have shown that a double thickness of 6 millimeters would also be satisfactory, the multiplication of interfaces always favoring soundproofing.

Therefore, the analysis of the prior art indicates that a sealing joint between intercommunication means and railroad or road vehicles being simultaneously able to bear all types of pulls while in operation, with the same level of soundproofing as that of the walls of vehicles and having a good resistance to fire while being economically manufactured and easy to set up, is not known.

SUMMARY OF THE INVENTION

In order to remedy the disadvantages displayed by conventional solutions, the purpose of the invention, is to design a device, that can be used as a sealing joint between intercommunication means and railroad or road vehicles or gangways to ships or to planes that is simple and economical to manufacture and that displays all the characteristics of mechanical resistance, of acoustic insulation and resistance to fire which are needed for the application.

The invention consists of two U-shaped membranes forming a flexible tubular joint, assembled in rest position by the symmetry plane of said tubular joint, said membranes being perfectly sealed and continuous, along the entire periphery of an intercommunication tunnel. In the closed flexible structure, thus manufactured, is introduced a moderate relative pressure, for instance a pressurization of about 0.2 bar.

When such a moderate internal pressure is applied on a 6 millimeter thick rubber sheet with modules usual in highly fireproof synthetic rubber compounds for instance about 60 millimeters wide, a tension of about 6 Newton per centimeter will create very low stretch. This low elongation does not impair the resistance to rolling stress between two plane walls, facing one another, in order to keep parallel the branches of the U between the rigid wall of the vehicle and the intercommunication tunnel.

Furthermore, an analysis of stresses exerted upon the rectilinear wall that connects the two U-shaped membranes indicates that all loads and pulls that might be applied on said intercommunication tunnel are easily born by the moderate pressure inside the volume made up of the two membranes.

The — permanent and variable — loads of a few hundred kilograms are balanced, with the same curvature radius of the membranes by a difference of a few centimeters in the length set up between the top joint, located at the ceiling, and the bottom joint, located under the floor, said difference being measured in the lengthwise direction of the vehicles.

The variation of those strains, which are exerted at constant pressure as a result of the nearly constant volume of the structure, is easily balanced by the flattening of both walls which then stretch the support surface of the joint on it.

The separation of the walls on the opposite sides sharply acts by shortening that support surface.

The result is a return stiffness that does not exceed a centimeter of separation in the case of the strongest forecast pulls.

During a rotation, resulting from the travel of the vehicle on a curve, the lateral sections of the tubular joint, thus formed by the U-shaped membranes, roll without strain on their support plane, while displaying significant return stiffness to lateral forces. Computations prove that no mechanical link is needed to support and return elastically to a balance position the intercommunication tunnel.

Such low pressure — of about 0.2 times the atmospheric pressure — is very easy to maintain during several months, permanently, with periodic monitoring or automatic detection, and acts as an excellent warning means before a failure, at the slightest crack, long before the rolling ability of the joint is impaired.

BRIEF DESCRIPTION OF THE DRAWINGS

The invention and its various embodiments will be understood better upon reading the following description relating to the drawings, wherein.

DESCRIPTION OF THE PREFERRED EMBODIMENTS

Figure 1:
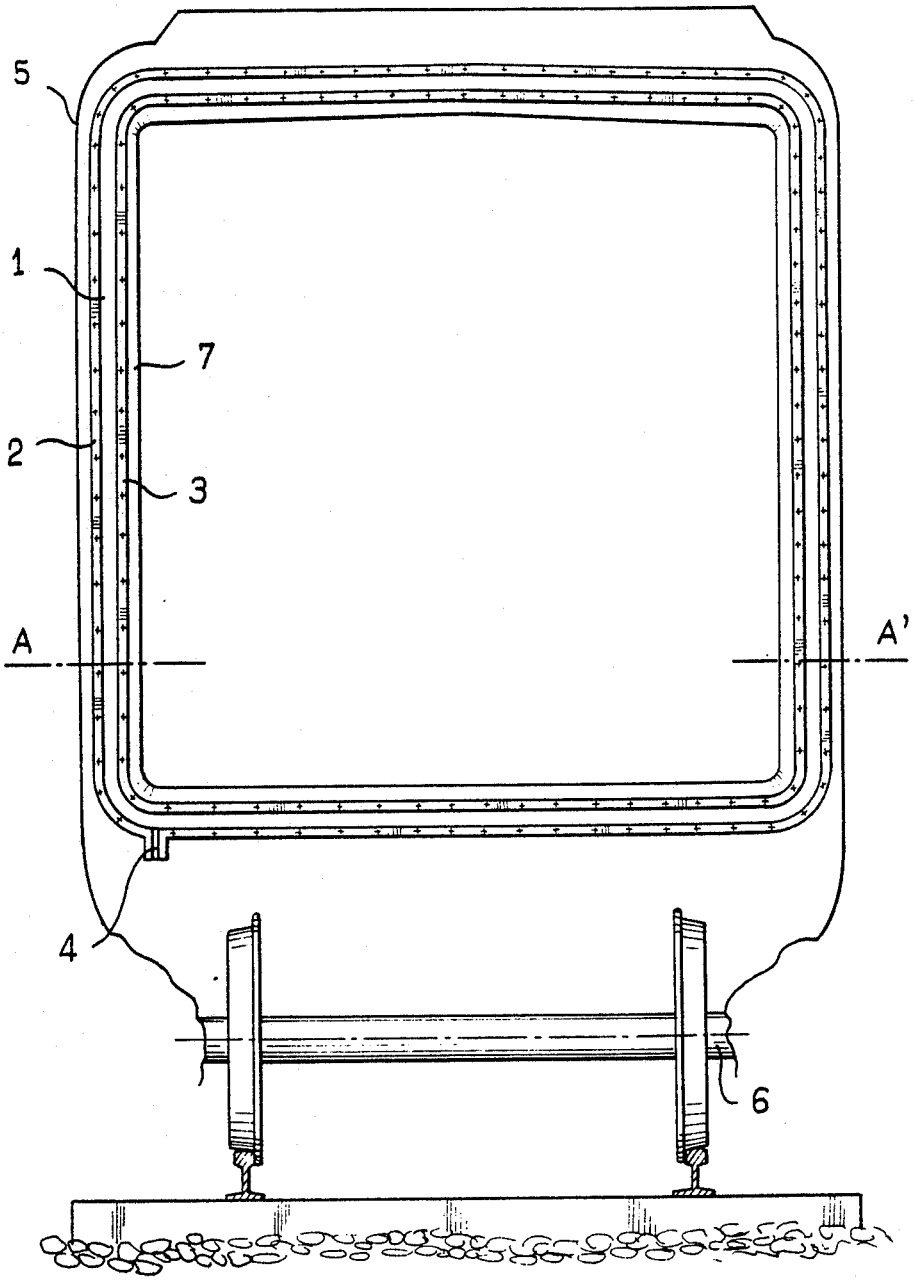
FIG. 1 is a general view of the joint in a plane that is perpendicular to the axis of the vehicles.

FIG. 1 is a view along the axis of the vehicle, sectioned by the fastening plane of the tubular joint in conformance with the invention.

The tubular joint (1) is fitted to the body of the vehicle (5) by an externally fastened rigid frame (2). Another internally fastening rigid frame (3) connects the tubular joint(s) to the intercommunication tunnel (7).

Tightening of the tubular joint (1) with nuts (or rivets) is done parallel to the axis of the vehicles.

Internal pressure is introduced and monitored by known means such as a valve (4) that can be placed at any point of the tubular joint (1).

The outline of the outer profile of the vehicles (5) and of the axle of the vehicle (6) shows the relative positions of the intercommunication tunnel (7) and of the walls of the vehicles (5), the main purpose being to set up free passage as large as possible from one vehicle to the next for psychological and visual reasons.

Figure 2:
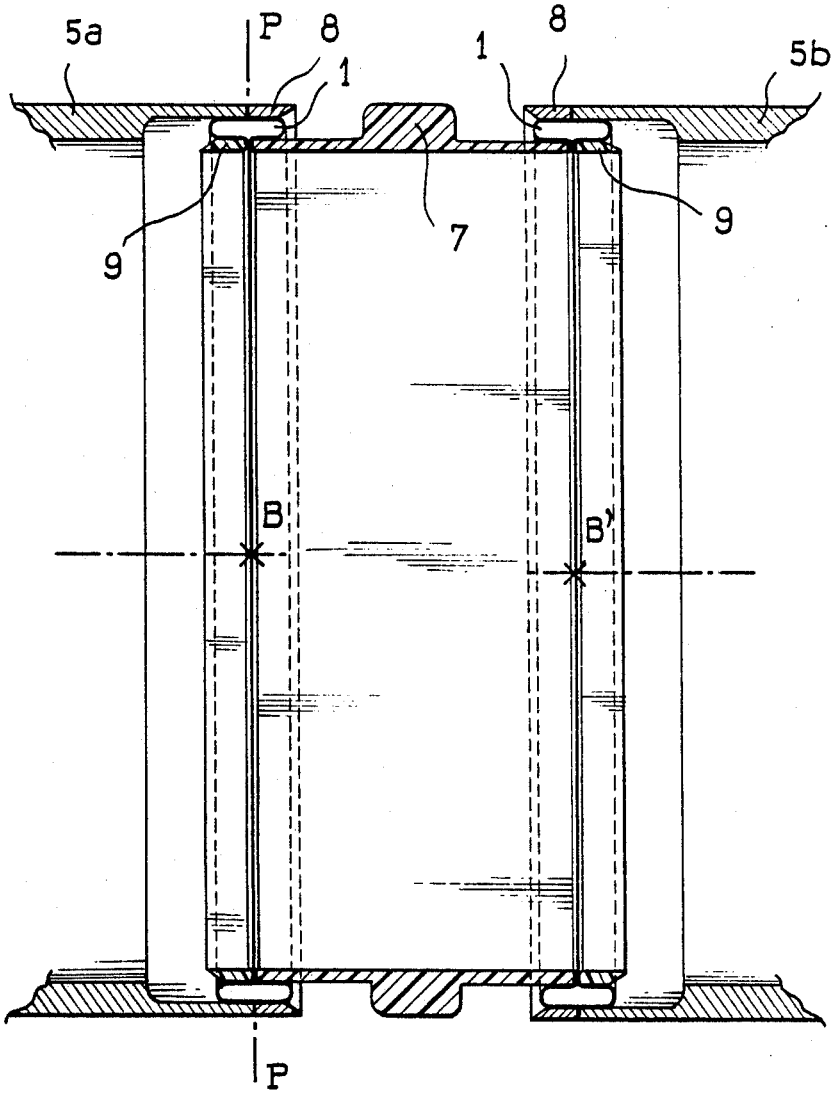
FIG. 2 is a horizontal section of the side walls of the vehicles and of the intercommunication tunnel, connected by a rolling joint, in conformance with the invention, at each of the ends of said intercommunication tunnel.

FIG. 2 is a horizontal section, according to AA' of FIG. 1, of the side walls of the vehicles (5*a*) and (5*b*) and of the intercommunication tunnel (7), all flooring having been removed. The side wall, thinned in that region, depicted by section (5*a*) or (5*b*) as well as the floor and the ceiling of the two ends of the vehicles surround, along the entire periphery, the complete intercommunication tunnel (7).

The parallel side housing of the two tubular joints (1) is extended by an outer profile (8), for the walls of the vehicles (5*a*) and (5*b*) and by an inner profile (9) for the intercommunication tunnel (7), those two profiles (8) and (9) being depicted here with their end chamfered.

The rotation distortions by twisting the tubular joints (1) take place around the vertical axes that are depicted in (B) and (B').

The usually plane support side of the tubular joints (1) can accommodate optionally a cylindrical curvature around axes (B) and (B').

Figure 3:
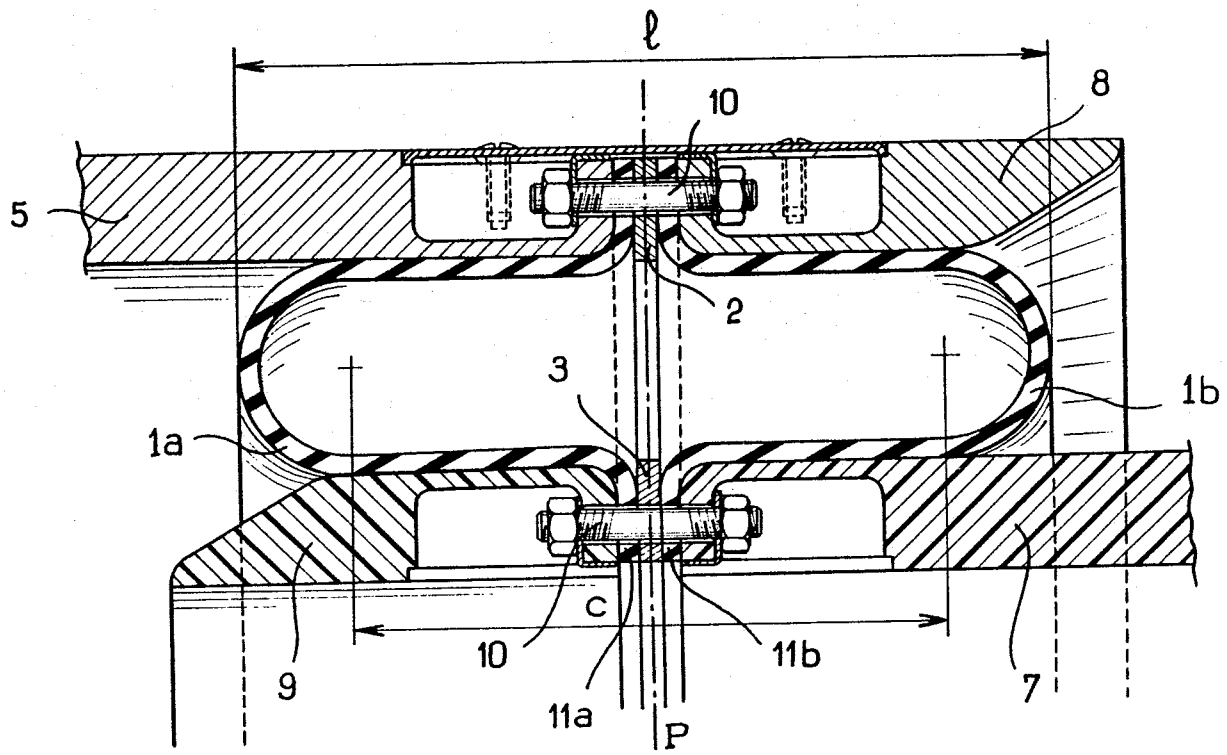
FIG. 3 is an enlargement of the preceding, in the zone of a joint.

FIG. 3 is an enlargement of FIG. 2 which details the U-shaped section of the two membranes (1*a*) and (1*b*) that forms the tubular joint.

Said membranes (1*a*) and (1*b*) are not subjected, during operation, to significant stresses or strains that would require special compounding of the rubber-based mixture for a high dynamic resistance. Therefore, the rubber compounder can search for a composition of the rubber-based compound enabling the highest fire resistance and/or phonic insulation.

With respect to fire resistance, there are several compounding possibilities for rubber-based compounds, but the two most efficient solutions are in the choice of the elastomer and its fillers.

Hence, it is advantageous to choose the elastomer among polymers having in their molecular structure, halogen atoms such as chlorine or bromine. Among such usual elastomers, the rubber compounder can select, as non-limiting examples, polychloroprene, chlorinated polyethylene, chlorobutyl or bromobutyl. Elastomers that contain in their molecule fluorine atoms might also be used, but this solution will not be the most economical.

Among the fillers, the rubber compounder can choose advantageously among the borate class — such as sodium borate — or still among chlorinated paraffins which will have to be associated with antimony oxide or hydrated alumina.

With respect to the improvement of phonic insulation, while preserving fireproof properties, the rubber compounder can associate with the previously mentioned elastomers lead salt or oxide-based fillers such as lead monoxide.

The fastening of the tubular joint formed by the two membranes (1*a*) and (1*b*) will be made easier by a preliminary setting up on the external rigid frame (2), for instance metallic, and on the analogous internal frame (3), said frames being completely independent from one another and their strength enabling the manipulation of the tubular joint (1), which is itself flexible since it is comprised of the rubber membranes (1*a*) and (1*b*), formed by vulcanization of a rough rubber shape.

A convenient setting up of said tubular joint (1) consists of a preliminary setting up on the frames (2) and (3) by hooping or by screwing pins (10). Then the membranes (1*a*) and (1*b*) — preferentially previously bored are threaded, before the unit is laid, on one direction onto the walls of the vehicle (5) and onto the internal profile (9), and the other direction onto the external profile (8) and onto the intercommunication tunnel (7) itself.

The ends (11*a*) and (11*b*) of the membranes (1*a*) and (1*b*) will be tightened, in order to ensure sealing, with nuts on threads of each pin (10) as depicted or else, optionally, with screws (not shown) that can be fitted in a threading arranged inside the profiles (8) and (9).

The inflation and monitoring valve (depicted at (4) in FIG. 1) will be advantageously composed of a tube that is fastened to the external rigid frame (2) and located at a low point which thus enables the evacuation of condensation.

Figure 4:
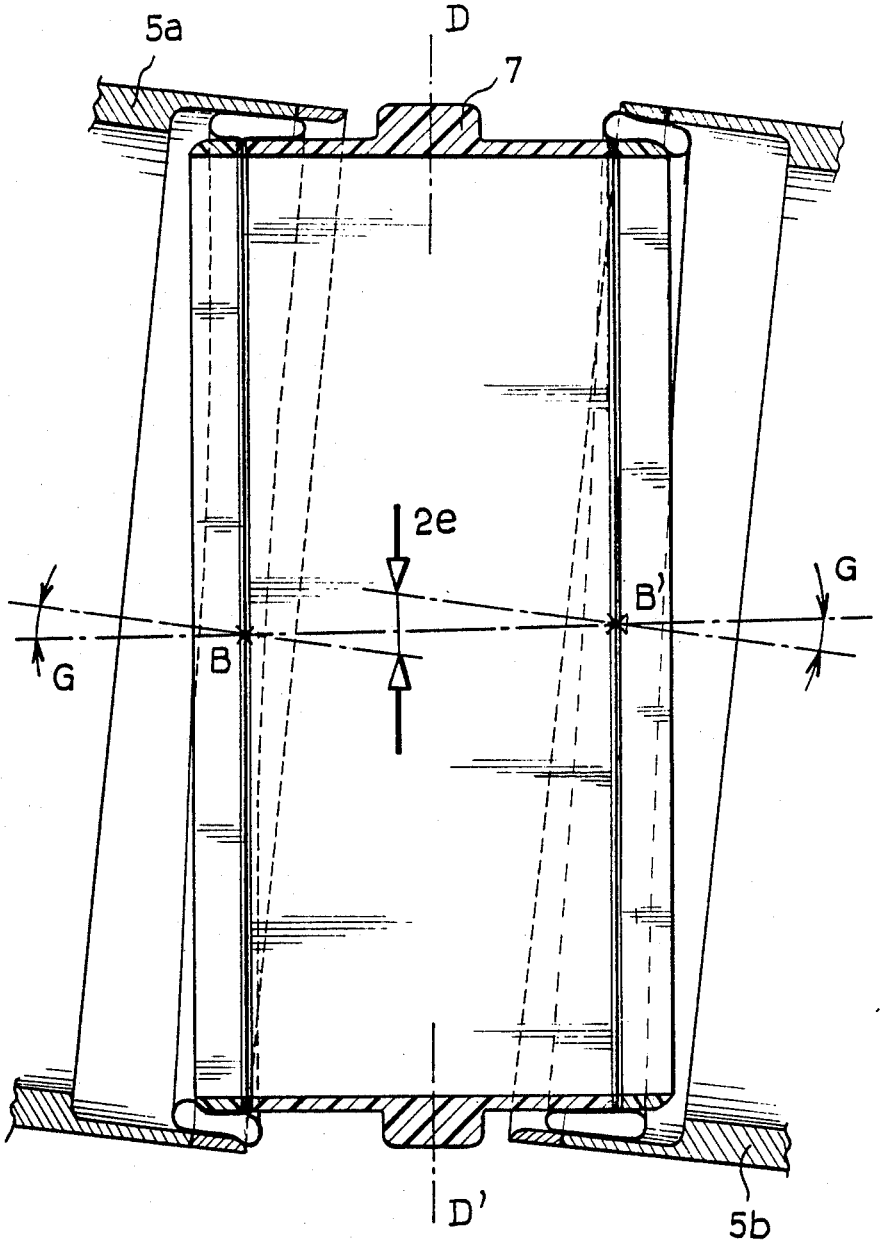
FIG. 4 depicts the elements of FIG. 2 when subjected to rotation distortion.

FIG. 4 depicts a distorted position of the unit which is illustrated in an straight position in FIG. 2.

If there is an angle (G) between the vehicle (5*a*) and the intercommunication tunnel (7), there will be an angle (2G) between the axes of two consecutive vehicles travelling along a curve, by symmetry to the plane DD'.

On the contrary, FIG. 4 depicts the most unfavorable case for intercommunication when thee is also an angle (G), in the opposite direction, between the other vehicle (5*b*) and the intercommunication tunnel (7), in other words, when the axes of the two vehicles are parallel, during a switch crossing for instance. Then the vehicles shift laterally from a correction (2*e*) equal to the product of the distance between the axes (B) and (B') and the tangent of the angle (G).

Figure 5A:
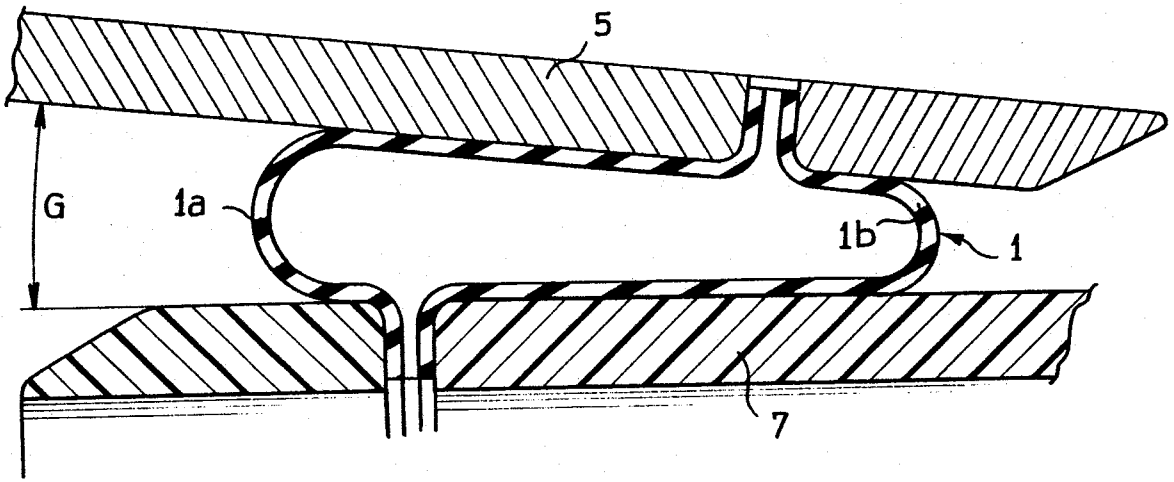
FIG. 5 is an enlargement of the preceding; it acts as a diagram for the computation of distortions in the tubular joint.
Figure 5B:
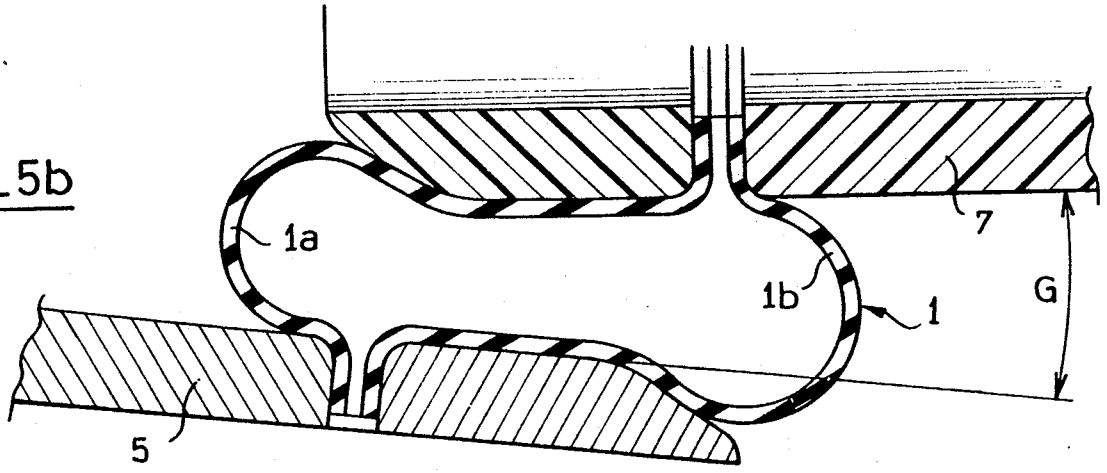

FIG. 5 is a simplified enlargement of the tubular joint (1) itself. What is shown is only the diagram of the most important distortions of said tubular joint (1); this diagram applies to the whole vertical section along the vertical walls (5) and the intercommunication tunnel (7), according to the plane of section AA' of FIG. 1.

In view 5*a*, the distortions resulting from angle (G) are added to a rolling motion that brings the intercommunication tunnel (7) at a maximum towards the inside of the vehicle.

On the contrary, in view 5*b*, the distortions resulting from angle (G) are added to an unwinding motion that pulls the tubular joint (1) from its housing, which, for that reason, is chamfered at its ends.

This diagram has been used to calculate the balance of the forces which are exerted by the pressure — internal to the volume enclosed by the tubular joint (1) — on the walls of the housing of said joint. These forces are equal, by unit of height, to the product of the internal pressure by the length (C) of the support line (which can be seen in FIG. 3) when there is no angular deviation.

The variation of those forces, when a crosswise acceleration effort is exerted, results from the increase in length of that support line (c) on the overloaded side and from the simultaneous reduction of that length on the unloaded side.

The order of magnitude of the stiffness due to this flexible connection will be close to 1 centimeter for accelerations such as 0.15 times gravity which are within the usual lateral comfort limits.

The calculation of this stiffness for the section that is depicted in FIG. 3, when it applies to the horizontal parts of the tubular joint which corresponds to the floor and to the ceiling, makes it possible to ensure the balance of vertical loads, that are permanent and variable, of the intercommunication tunnel (7) without needing any other elastic device.

Vertical variations of less than one centimeter can thus be balanced between the minimal empty state and the maximum allowed load.

One skilled in the art will easily understand that the balancing of a permanent load can be obtained without varying the clearance of the walls, in other words, with the same curvature radius of the unstrained shell of the tubular joint on the sole condition that the overall length (b) shown in FIG. 3 and, therefore, the length of the support line (c), be different between ceiling and floor. This difference in length is the necessary quantity for balance, which requires only a few centimeters for the usual loads.

The diagram depicted in views 5*a* and 5*b* indicates that all the distortions take place at a nearly constant volume, without variation of that pressure when the same internal pressure, for instance 0.2 bar is exerted upon the whole periphery of the tubular joining (1) in both views. The tensile strength on the rubber sheet forming the membranes (1*a*) and (1*b*), for instance 0.6 daN per centimeter, creates very low elastic stretch of the elastomer therefore recoverable. This low elongation of about 2 to 3% of the periphery of the U-shaped section does not impair the dynamic resistance under flexion during rolling of the membranes and its purpose is simply to facilitate twisting, without folding the tubular joint during curvatures (depicted in FIG. 4).

In the event of a lack of pressure, the stiffness of the rubber sheet itself forming the membranes (1*a*) and (1*b*) is sufficient to ensure the more or less normal operation of the tubular joint (1) before it is replaced.

The tubular joint (1) must go very repetitively from the maximum close-in position depicted in view 5*a* to the maximum stretched position depicted in view 5*b*. This distortion through twisting of the tubular joint (1) is distributed along the whole width of the vehicle, only by shearing of the material in a lengthwise plane of the vehicle. This shearing is equal to about 10% in relative value; such as low shear will ensure a long dynamic life to the membranes and thus allows for an optimization of rubber-based compounds, particularly for their resistance to fire.

The return force towards the straight position from the previously described distorted state corresponding to the maximum value of angle (G) results almost only from the twisting of the tubular joint, due to shearing of the rubber sheet forming the membranes (1*a*) and (1*b*) and therefore is also quite moderate.

A rolling of the tubular joint (1) parallel to the axis of the vehicles resulting from low elastic variations in the length of the coupling between the consecutive vehicles (5*a*) and (5*b*) will occur without strain. The length (b) of the arch shaped membranes (1*a*) and (1*b*) remaining constant (see FIGS. 2 and 3).

The two support sides having a length (c) shift on the rigid walls by the unwinding motion of the tubular joint through flexing. This is the sole very low strain acting against the shift.

Under the distortions depicted in views 5*a* and 5*b*, a very low straightening torque is exerted as a result of different curvatures in the unstrained section. The diagram indicates that the rotation occurs — more or less — around one of the vertical axes (B) and (B') shown in FIG. 4.

An elastic return elongation will not exceed a centimeter in the event of lateral forces.

The strongest pulls against rotation might be rather due to the shear twisting on the wall of the tubular joint (1); they are of a low value, almost unnoticeable compared to forces exerted by the lateral suspensions of the vehicles.

The same does not apply at all to the rolling connections around a lengthwise axis of the vehicles (5) that are connected by the intercommunication tunnel (7) through the two successive tubular joints (1) which are then arranged in series on the differential twist angle between said vehicles.

This elastic rolling return torque resulting also from the shearing of the whole thin shell of the membranes (1*a*) and (1*b*) but here the shearing being exerted in a plane that is crosswise to the vehicles will be substantially dampened by the sliding of the membranes on the walls. No folding of the membrane will occur owing to the tensile strength due to internal pressure. But, this return torque has a lever arm which is so significant around the rolling center that the order of magnitude for the elastic connection between two vehicles, will be at least equal to the return rolling torque due to the primary and secondary suspension of the vehicle.

At the usual speeds of trains fitted along their entire length with this kind of intercommunication devices this connection between vehicles will be at least as important when the vehicles come into a slant in a curve as the differential elastic return torque due to the suspensions. Thus each vehicle is pulled, mainly, by its predecessor. The same applies to the return to the straight position resulting from the exit of the slant.

Figure 6:
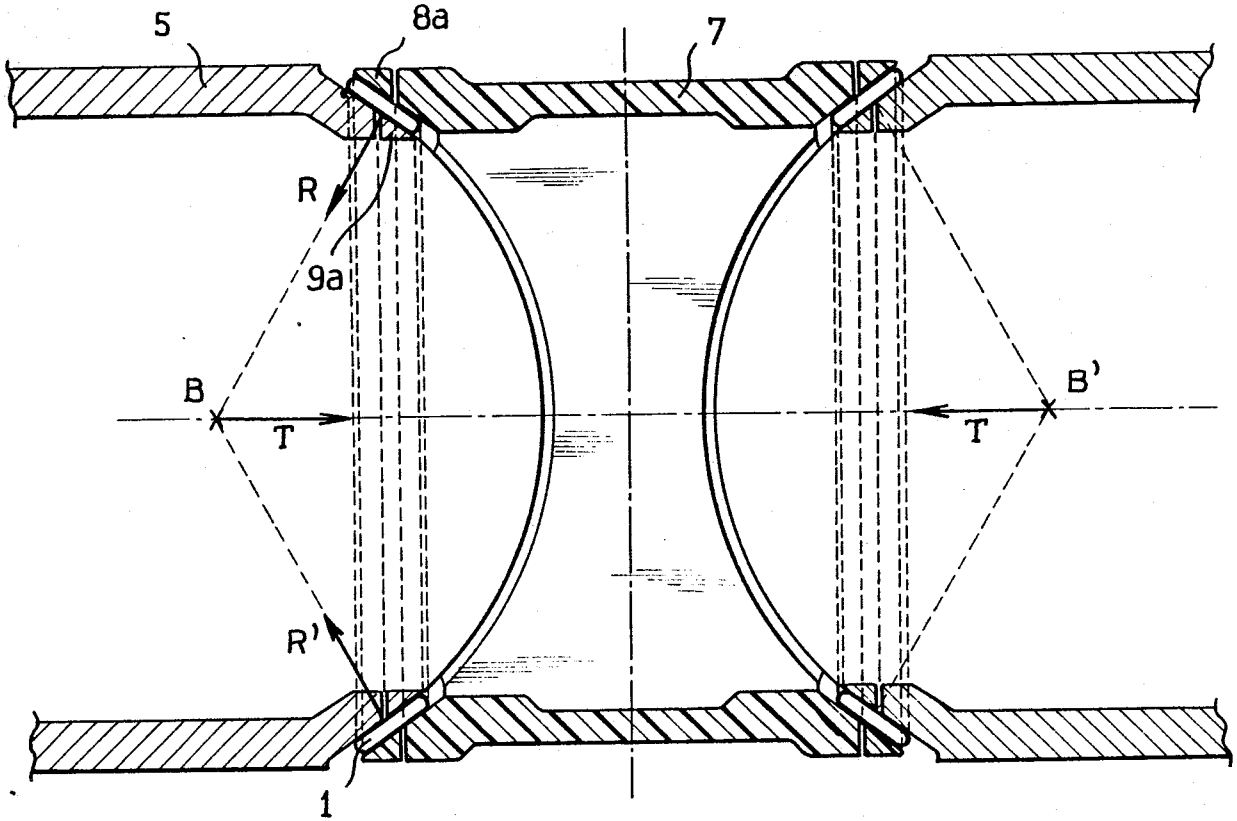
FIG. 6 is an embodiment in which the distortion center is located outside of the tubular joint.

FIG. 6 depicts another embodiment interesting for floor kinematics, in which the instantaneous vertical rotation axes (B) and (B') are separated from the laying plane of the tubular joint (1).

In this embodiment, the intercommunication tunnel (7) surrounds the end of the vehicles (5), contrary to the previous configuration where said tunnel was internal.

A permanent separating reaction of the vehicles, independent from the position of the couplings and which is lower, than 10% of the usual traction effort, must balance the oblique reaction on the support planes of the tubular joints (1). The purely axial combined force (T) of pressure reactions (R) and (R') perpendicular to the support planes tends to separate the two vehicles that are connected by an intercommunication tunnel (7).

All the explanations pertaining to FIG. 4, for a travel curvature which is the cause of an angle (2G) or of a transverse separation (2*e*) between the axes of the vehicles still applies, in this case of separation of vertical rotation axes, from the laying plane of the tubular joint. The explanations do not apply to lengthwise motions of the coupling. Such motions occur at variable volume for the tubular joint (1). For this reason a clearance will have to be provided for to be compatible with the usual motions. In the event of accidental maximum compression there will be a contact of the walls of the vehicles (5) with the intercommunication tunnel (7). For this reason anti-lapping devices will have to be provided for and then the membranes will come into physical contact, along a wide surface, thus resulting in an increase of internal pressure which might produce a bulge of the unstrained internal and external arches of the tubular joint (1). Therefore, said tubular joint (1) will have a bursting limit sufficient to withstand such extreme accidental conditions.

Figure 7:
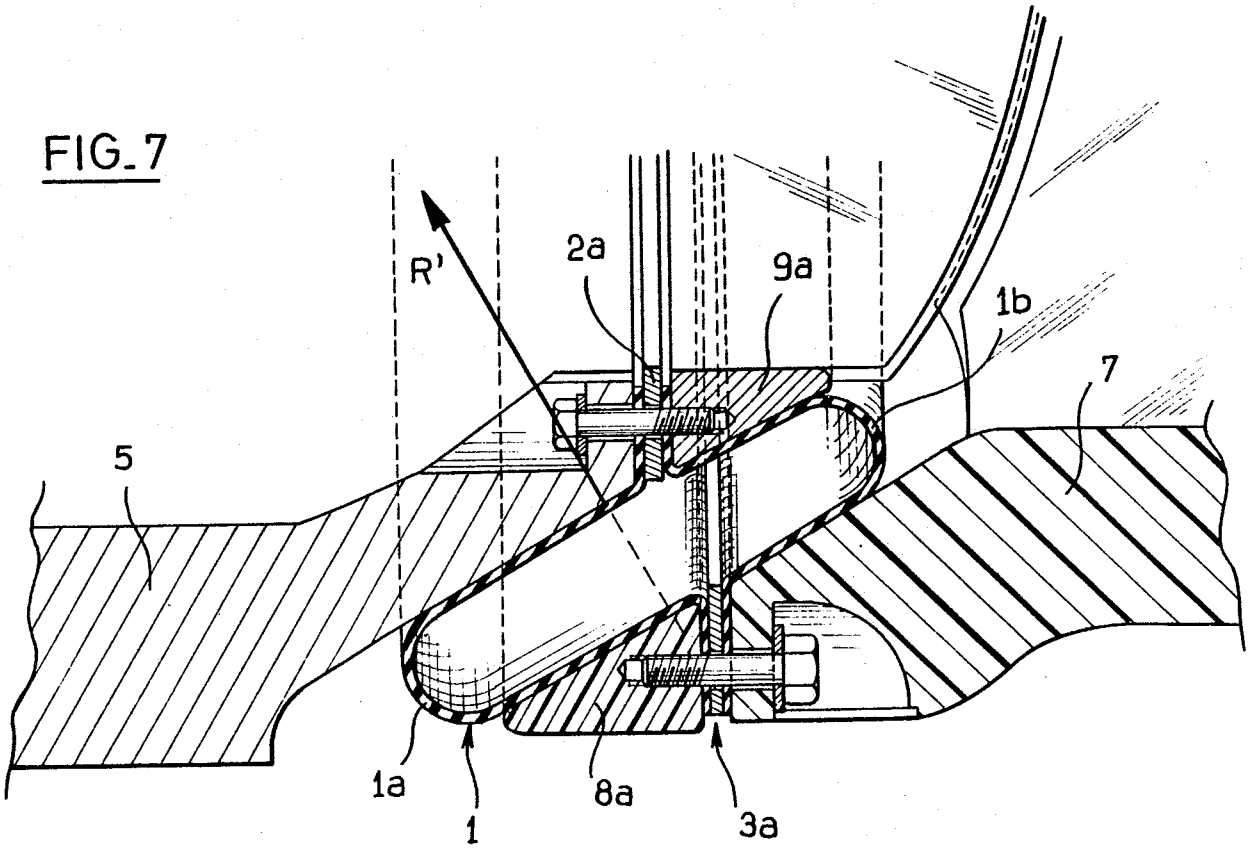
FIG. 7 is an enlargement of the preceding which shows an assembly embodiment of the tubular joint.

FIG. 7 is an enlargement of FIG. 6, showing the tubular joint (1) itself.

In this embodiment, said tubular joint (1) is laid out along the protrusion (9*a*), which is now internal, with a slight tensioning. In another embodiment it is possible to simplify this lay out by not using the frame (2*a*), which was shown internal in FIG. 3 because the tubular joint (1), which was previously set up can be handled by simply being put around protrusion (9*a*).

A similar simplification is possible by not using the frame (3*a*), which is shown external on FIG. 3, if the tubular joint (1) is handled after having been set up on the protrusion (9*a*), which is now external, of the intercommunication tunnel (7).

The protrusions (8*a*) and (9*a*) are conical in the curved parts; they are rectilinear and oblique in the lateral and horizontal parts.

When one or the other of the rigid frames (2*a*) and (3*a*) are not used one of the basic characteristics of the invention still remains; the fitting of the tubular joint (1), by its fastening plane, is perpendicular to the axis of the vehicles. Due to the high flexibility of the U-shaped membranes (1*a*) and (1*b*) there is no need to alter the manufacturing process for this embodiment as compared to that described in FIG. 3.

A manufacturing process, among the most economical, is the moulding, of each one block U-shaped membrane from a continuous rubber compound placed in a compression mould of the size of the membrane which can be heated by any means used in the rubber processing industry, such as an autoclave, elastic clamps ensuring airtight closure of the mould during the process. The holes in the membranes can be thus obtained during the moulding.

The previous set up on the protrusion which was described in one of the embodiments (see FIG. 7) implies an optional intermediate gluing of the U-shaped membranes on their opposite plane sides, with or without insertion of internal and external rigid fastening frames.

An alternative which favors even more acoustical insulation, is the replacement of air, in the internal volume defined by the U-shaped membranes, by a heavy gas in which the propagation speed of sounds is lower than in air, such as carbon dioxide, which improves resistance to stress of rubber-based compounds and is harmless to passengers in the event of a leak or fire.

Furthermore, in the event of a fire, the use of such a gas displays the advantage of increasing fire resistance of the tubular joint by limiting the presence of oxygen and therefore reducing combustion.

ADVANTAGES OF THE INVENTION

In summary, the flexible tubular joint, subject of the invention, which is of two rolling membranes, that are U-shaped, according to the symmetry plane of said joint and enclosing a gas — most often air — at low pressurization, displays the following advantages:

it is able to withstand all mechanical pulls that are exerted on an intercommunication tunnel connecting two consecutive railroad or road vehicles or access gangways, which enables a cleared passage along the whole width of the vehicles, it allows very high durability, it ensures an acoustical insulation in the flexible parts, as good as that in the walls of conventional vehicles, it can be manufactured from a rubber-based compound with optimal fireproof properties, its manufacture is economical since it does not include any reinforcement element, it is easy to lay up due to the previous set up that facilitates it handling, it "warns" of the imminence of a failure, through the periodic or permanent monitoring of the pressure of gas contained in the enclosed volume formed by the two U-shaped membranes.

APPLICATIONS OF THE INVENTION

The invention relates to intercommunication tunnels designed to connect at least two successive railroad vehicles, subway cars or road vehicles, such as tramways or articulated buses.

One skilled in the art can obviously make to the device an its illustrated embodiments described as non-limiting examples, various modifications and variations without departure from the spirit and scope of the invention.

I claim:

1. A tubular joint for connecting an intercommunication tunnel placed between two successive vehicles or two members of an access gangway to a ship or plane, said vehicles and members having upper and lower walls that are generally horizontal and lateral walls that are generally vertical to form an enclosed passenger passageway, said tubular joint comprising:

a pair of rolling membranes that are U-shaped and mounted to form a gas tight chamber therebetween on the opposite sides of a symmetry plane;

said chamber being inflated with a gas under a relative pressure of about 0.1 to 0.5 bar; and said membranes each having one end fitted to the upper, lower and lateral walls of one of said vehicle or member and an opposite end fitted to said tunnel with the respective ends of said membranes secured by fastener means extending through said symmetry plane and effective to withstand all pulls exerted on the intercommunication tunnel forming said passageway.

2. A tubular joint for connecting an intercommunication tunnel forming a passage compartment placed between two successive railroad or road vehicles or two successive members of access gangways to ships or to planes, said tubular joint being fitted on one hand to lateral, upper and lower walls of said vehicles or of said access gangways and on the other hand on said intercommunication tunnel, and being inflated with a gas under a relative pressure of 0.1 to 0.5 bar; said tubular joint having a symmetry plane and being composed of two rolling membranes (1*a*), (1*b*), that are U-Shaped, assembled by tightening of their ends (11*a*) and (11*b*) in said symmetry plane of said tubular joint (1) to provide a connection which can withstand all pulls exerted on the intercommunication tunnel.

3. A tubular joint according to claim 2, characterized in that the thickness of the rolling membranes is at least equal to 6 millimeters to ensure a soundproofing that is equivalent to that of the walls of said railroad or road vehicles or access gangways.

4. A tubular joint according to claim 2, characterized in that the rolling membranes are made of a rubber-based compound without any textile or metallic reinforcement.

5. A tubular joint according to claim 4, characterized in that the compound used for the manufacture of the rolling membranes includes, in its molecular structure, halogen atoms of chlorine or bromine.

6. A tubular joint according to claim 5, wherein said compound is polychloroprene, chlorinated polyethylene, chlorobutyl or bromobutyl.

7. A tubular joint according to claim 4, characterized in that the rubber-based compound used for the manufacture of the membranes includes fillers to improve fire resistance.

8. A tubular joint according to claim 7, characterized in that the rubber-based compound used in the manufacture of the membranes includes lead salt fillers or lead oxide fillers, to improve acoustic insulation.

9. A tubular joint according to claim 2, characterized in that the symmetry plane used for fastening the rolling membranes is reinforced by one rigid external frame and by one rigid internal frame which enable fastening of said tubular joint respectively on the end of said railroad or road vehicles or of said access gangway and on the end of said intercommunication tunnel forming a passage compartment.

10. A tubular joint according to claim 9, characterized in that a valve for inflation of said tubular joint and monitoring of the internal pressure is fitted on the rigid external frame where failure of the joint is indicated by a reduction of said inflation pressure.

11. A tubular joint according to claim 2, characterized in that the gas which is enclosed in a volume limited by the rolling membranes is a heavy gas with slow sound transmission speed.

12. A tubular joint according to claim 11 wherein said heavy gas is carbon dioxide.

* * * * *